US005586787A

United States Patent [19]

Brown et al.

[11] Patent Number: 5,586,787

[45] Date of Patent: Dec. 24, 1996

[54] METHOD AND APPARATUS FOR PREVENTION OF REGISTER RECEIPT FALSIFICATION

[76] Inventors: Jerry W. Brown; Stewart Brubaker, both of 4303 Victory Dr., St. 303, Austin, Tex. 78704

[21] Appl. No.: 360,984

[22] Filed: Dec. 20, 1994

[51] Int. Cl.[6] ..... B42D 15/00

[52] U.S. Cl. ..... 283/67; 283/92; 283/902; 283/60.1

[58] Field of Search ..... 283/67, 70, 72, 283/91, 92, 114, 902, 60.1, 60.2

[56] References Cited

U.S. PATENT DOCUMENTS

| | | | |
|---|---|---|---|
| 192,624 | 7/1877 | Hix . | |
| 1,819,375 | 8/1931 | Matthews . | |
| 4,451,521 | 5/1984 | Kaule et al. | 283/67 |
| 4,736,425 | 4/1988 | Jalon . | |
| 4,957,312 | 9/1990 | Morello . | |
| 5,064,221 | 11/1991 | Miehe et al. . | |
| 5,120,088 | 6/1992 | Radcliffe et al. . | |
| 5,209,513 | 5/1993 | Batelli et al. . | |
| 5,279,222 | 1/1994 | Di Luco . | |

*Primary Examiner*—Willmon Fridie, Jr.
*Attorney, Agent, or Firm*—Richard C. Litman

[57] ABSTRACT

The present invention relates to a method and apparatus for preventing the forgery of paper records. The method includes providing at a manufacturing site paper and a marking agent having a pre-determined and identifiable photoluminescent characteristic; printing fixed indicia on the paper using the marking agent; transferring the paper to a point of sales site; installing the paper in a printing apparatus capable of both piercing the paper and printing variable indicia on the paper; and piercing the paper to form an aperture therethrough.

12 Claims, 2 Drawing Sheets

METHOD AND APPARATUS FOR PREVENTION OF REGISTER RECEIPT FALSIFICATION

BACKGROUND OF THE INVENTION

1. FIELD OF THE INVENTION

The present invention relates to a method and apparatus to prevent the forgery of cash register receipts, checks, negotiable instruments of all types, and other important documents whose authenticity must be ascertainable.

2. DESCRIPTION OF THE PRIOR ART

It is a common practice of many retail stores to accept returned items directly at the point-of-sale counter when the returned item is presented along with a sales receipt for the item. For instance, if a consumer wished to return a newly-purchased television, he or she would take the television to the consumer electronics department of the store from which it was purchased. Upon presenting a sales slip as proof of purchase, many, if not most, department stores would then promptly return the purchase price of the television.

Unfortunately, many counterfeiters have found that this practice is ripe for fraud by forgery. Many stores use sales slips which are nothing more than a slip of conventional paper with sales data printed upon it. To perpetrate the fraud, the counterfeiter first legitimately purchases an item from the target store to study the appearance of the sales receipts issued by the target store.

The counterfeiter then forges a sales receipt for a relatively small, expensive item. The forger himself, or more often a co-conspirator, then shop-lifts the item described on the forged sales receipt from the target store. Then, a third co-conspirator returns the stolen item to the target store for a cash refund presenting as proof of purchase the forged sales receipt.

The target store, in the interest of prompt customer service and satisfaction, normally refunds the purchase price of the item with only the most cursory examination of the sales receipt. It is not until long after the fraud has been perpetrated that the forgery is discovered. By this time, the conspirators are already targeting a different store in a different town for the same treatment. In this manner, small, three-person forgery teams move from town to town, always one step ahead of the law.

This practice is particularly damaging to retailers because, unlike shop-lifting, in which the retailer loses the wholesale purchase price of the stolen item, in sales receipt forgery the retailer loses the entire retail price of the item, plus the amount of any sales taxes depicted on the forged receipt. Not only has the retailer lost the actual cost of the item itself, but the retailer has also lost the profit-margin reflected in the retail price of the item and the taxes included on the forged receipt.

To add further insult to injury, the cash given to the thief decreases the liquid cash reserves of the retailer. This has a particularly devastating effect on retailers because they tend to be very cash-poor organizations. The vast majority of retailers' assets are tied up in illiquid inventory which is leveraged with a rotating credit line in order to maintain a sufficiently large inventory of goods. At any given instant, only a very small amount of cash is available to a retailer. Cash realized from the sale of goods is used to pay interest on the rotating credit line and dividends to the stockholders, with the remaining cash being plowed back into inventory purchases. Overall, such retail stores can be extremely profitable, while still maintaining a relatively small reserve of cash assets. Because of this small cash reserve, sales slip fraud severely hampers the profitable operation of a leveraged retail store by further decreasing their already-limited cash liquidity.

While the above discussion is limited to sales receipts, similar types of forgery schemes affect all types of negotiable instruments, business documents, and other paper instruments whose authenticity denotes value, including bank checks and their equivalents (money orders, cashier's checks, postal money orders, etc.), coupons, lottery tickets, admission tickets, air travel boarding passes, and the like. For the sake of brevity and clarity, this specification shall discuss only the prevention of the forgery of proof-of-purchase sales receipts using the present invention. This should in no way be construed as limiting the present invention in any manner. The claimed invention functions to hamper the forgery of any type of paper document whose authenticity guarantees the holder of the document, or a person named on the document, something of value.

Several patents describe sales receipt papers, and methods of printing sales receipts and other important documents which are designed to thwart would-be forgers. For instance, an early patent, U.S. Pat. No. 192,624, issued Jul. 3, 1877, to A.E. Hix, describes a method of forming a stenciled impression on paper in which the paper to be stenciled is placed on top of an ink pad, with a sheet of blotter paper interposed between the paper to be stenciled and the ink pad. A stencil pen is then pierced through the paper and the blotter paper and into the ink pad below. When the stencil pen is withdrawn, a small amount of ink is deposited on the reverse side of the stencil paper. To determine if the entire stencil has been properly formed, the stenciled paper is inverted and the stenciled pattern can be determined by viewing the inked pattern on the back of the paper.

U.S. Pat. No. 1,819,375, issued Aug. 18, 1931, to F.J Matthews, describes a roller device for imprinting or puncturing, variable pattern over the signature on a negotiable instrument The variable pattern of dots or holes over the signature makes it difficult to alter or forge the signature.

A security marking method which utilizes fluorescent chelate is described in U.S. Pat. No. 4,736,425, issued Apr. 5, 1988, to M. Jalon. Chelates are a group of chemicals which are formed from two chemical entities: an organic ligand, and a metallic element The organic ligand surrounds and binds to the metal element. Many ligand-metal combinations will fluoresce with a very specific spectrum under visible, U.V., or infrared light. Here, the paper to be marked is pre-treated with either the ligand, or the metal element. Alone, both of these chemical entities are completely invisible. To test the authenticity of the paper, the other chemical entity (i.e., the other of the ligand or metal element) is applied to the paper. The light spectrum of the paper is then analyzed to determine if the proper chelate has been formed.

U.S. Pat. No. 4,957,312, issued Sept. 18, 1990, to P.S. Morello, describes a method of preventing sales receipt forgery by using an inked ribbon in which the ribbon is split lengthwise into various different regions. The different regions are then impregnated with different colors of ink. The sales receipts formed using such a ribbon contain alphanumeric characters in which the characters are formed from patterns of different colors of ink. This makes the receipts far more difficult to forge.

U.S. Pat. No. 5,064,221, issued Nov. 12, 1991, to F.V. Miehe et al., describes a method of distinguishing an original printed article from a copy thereof. At the time of printing, an invisible fluorescent ink grid is sprayed or impressed onto the substrate, along with the visible indicia. When passed under a U.V. scanner, the fluorescent ink grid, normally invisible, will fluoresce.

Another method to prevent forgery by using luminescent ink is described in U.S. Pat. No. 5,120,088, issued Jun. 9, 1992, to W.W. Radcliffe et al. Here, luminescent ink is used in combination with a highly porous and absorptive register paper. The register paper is printed at the time of sale with a fluorescent ink which is absorbed completely through to the back side of the paper. The transaction record will then fluoresce on both sides of the register paper when passed under U.V. light.

U.S. Pat. No. 5,209,513, issued May 11, 1993, to O.C. Batelli et al., describes a method for preventing the counterfeiting of sales receipts which includes the steps of printing a fixed indicia on the register rolls with photoluminescent ink at the time of manufacture, installing a register roll into a cash register, and printing sales data (variable information) onto the register roll with photoluminescent ink. When a sales receipt is presented for a returned item, the receipt is passed under U.V. illumination, which will cause both the variable data and fixed indicia on the receipt to glow. The integrity of both the variable and fixed data can then be examined.

U.S. Pat. No. 5,279,222, issued Jan. 18, 1994, to E. Di Luco, describes a method and apparatus for forming a printing ribbon having segments of colored inks, dyes, or pigments placed serially in an alternating and predetermined sequence along the longitudinal length of the ribbon. The colors, and spacing of the segments along the length of the printing ribbon can be modified to provide for the printing of sales slips, bank checks and the like which are more difficult to counterfeit.

None of the above references, taken alone, or in any combination, is seen as describing the presently claimed method for the prevention of register receipt forgery.

SUMMARY OF THE INVENTION

The present invention provides a method and apparatus for minimizing the risk of forgery of paper documents by providing a paper record which has both fixed and variable indicia printed upon it. Both the fixed and variable indicia are formed using a marking agent which includes a photoluminescent agent. The present method also includes the step of forming small apertures in the record. The combination of photoluminescent marking agents, fixed and variable indicia, and physical apertures passing through the record itself, makes the record far more difficult to alter, forge, or reproduce.

The apparatus to form the records includes a first printing means to print fixed indicia on a first side of the paper workpiece. A second printing means prints the variable alphanumeric indicia on either the first side, or the second side of the paper workpiece. The apparatus also includes piercing means to form the plurality of apertures extending through the paper workpiece.

In view of the above discussion, it is a principal object of the present invention to provide a method and apparatus for the prevention of the forgery of paper documents.

Another object of the present invention is to provide a method using a combination of both photoluminescent marking agents and physical patterning to manufacture a paper document which is difficult to alter, forge, or reproduce.

Still another object of the present invention is to provide a method whereby the authenticity of a paper record can be ascertained by passing the record underneath an ultraviolet, visible, or infrared light source whereby the presence of a pre-determined photoluminescent marking agent can be determined.

These and other objects of the instant invention will become clear upon a complete reading of the "Detailed Description," below.

DETAILED DESCRIPTION OF THE PREFERRED EMBODIMENT

Figure 1:
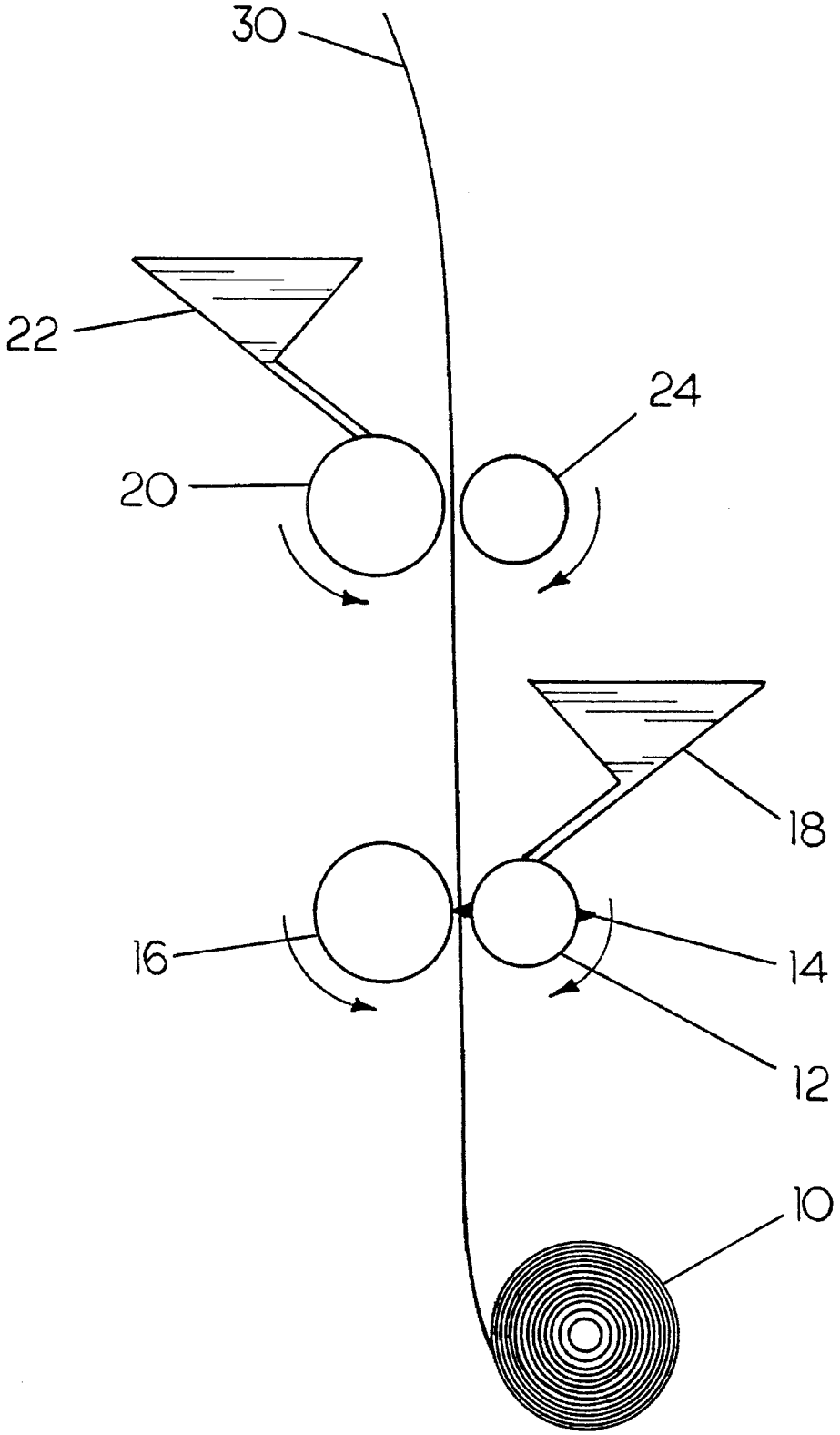
FIG. 1 is a schematic representation of an apparatus to print a sales receipt according to the method of the present invention.

Reference is made herein to the attached drawing figures. Like reference numerals are used throughout the various drawings to designate like elements of the claimed invention.

FIG. 1 depicts a schematic of an apparatus according to the present invention for printing tamper-resistant paper records. A paper workpiece 10, in the form a register roll, is fed to a first printing means 12 to print fixed indicia on a first side of a paper workpiece. As shown here, piercing means 14 is mounted on the same drum as printing means 12. This arrangement keeps the apparatus compact and easy to manufacture, although the piercing means may, and is preferably separate from printing means 12.

The first printing means 12 is shown as a rotating drum which both imprints a fixed indicia on the workpiece 12, and functions to advance the paper to the next stage of the process. Ink supply means 18 supplies a marking agent to the printing means 12 and piercing means 14.

It is preferred that first printing means 12 be an impact-type print head, such as a type-writer-type ribbon impact printing mechanism. Other printing mechanisms will function with equal success provided that the printing mechanism applies a chemical marking agent to the paper workpiece. Such printing mechanisms include all impact-type print heads, ink-jet type mechanisms, laser print mechanisms, xerographic-type print heads, and the like.

Piercing means 14 punches a plurality of apertures through the paper workpiece 10. The relative positions of the piercing means 14 and first printing means 12 may be such that they print on the same or different sides of the paper workpiece 10.

The piercing means is preferably a series of roller-mounted pins, as shown in FIG. 1. However, alternative embodiments, such as an arrangement of reciprocating piercing tines and corresponding ink supply pads, with the paper workpiece interposed between the two, will function with equal success. Other equal alternative embodiments are easily envisioned. The apertures can be formed in the paper workpiece at regular intervals or in various patterns. The spacial orientation of the apertures may be changed from time to time to thwart any forgers who happen to succeed in breaking the "code."

The paper workpiece is then fed to second printing means 20 and feed roller 24. The second printing means 20 prints variable alphanumeric indicia on the paper workpiece. The relative positions of the second printing means 20 and feed roller 24 may be reversed so that variable indicia may be printed on either or both sides of the paper workpiece. An ink supply 22 supplies a marking agent to the second printing means 20. The second printing means 20 can be any of the types of print mechanisms as mentioned for the first printing means.

Both the first and second printing means employ a conventional visible ink, dye, or pigment which also includes an agent which has a pre-determined and identifiable photoluminescent or photoreflective characteristic. Illustrative photoluminescent characteristics include ultraviolet fluorescence, visible fluorescence, infrared fluorescence, ultraviolet phosphorescence, visible phosphorescence, and infrared phosphorescence. Additionally, identifiable photoreflective characteristics would include agents which have unique and easily identifiable reflectance spectra in the UV, IR or visible wavelengths of light. When mixed with conventional marking agents, as in a mixed ink, such photoluminescent and/or photoreflective agents are invisible at visible wavelengths of ambient light. Ink supplied to the piercing means 14 and first, fixed printing means 12 may be limited to only photoluminescent ink which is invisible in the visible wavelengths of light. This makes forgery of the original record 30 far more difficult.

To verify the authenticity of a record manufactured using the claimed apparatus and method, the record is passed under a special light source which will activate the photoluminescence or photoreflectivity of the marking agent used. The special light source is chosen based on the photoluminescent characteristics of the pre-selected marking agent. Such special light sources may include UV and IR light sources, as well as visible light sources of selected wavelengths (for instance sodium, mercury, or tungsten lamps).

If the record is authentic, when placed under the special light source, apertures punched through the record will appear, along with the fixed indicia, and the unaltered variable indicia. If the record has been altered or forged, the visible portion of the variable indicia will not match the normally invisible photoluminescent indicia which were simultaneously printed on the original record. Or, the fixed indicia may not be a faithful reproduction of the original, or the apertures may not be placed in the same spacial orientation as the original. In this manner, the record so formed is extremely difficult to forge without exact knowledge of the marking agent used to form the fixed and variable indicia.

To further improve the present invention, different marking agents having different photoluminescent or photoreflective characteristics may be used to supply the first printing means, the second printing means, and the piercing means. Using this configuration, a would-be forger would have to have intricate knowledge of three different types of marking agents and their particular photoluminescent characteristics. Geographic separation of the formation of the fixed indicia and the apertures, as at a manufacturing site, and the formation of the variable indicia, as at a point of sale location, makes successful forgery of the records even more difficult because the retailer need not have knowledge of the composition of the marking agent used to make the fixed indicia, and the manufacturer of the paper need not have knowledge of the marking agent used to make the variable indicia.

Figure 2:
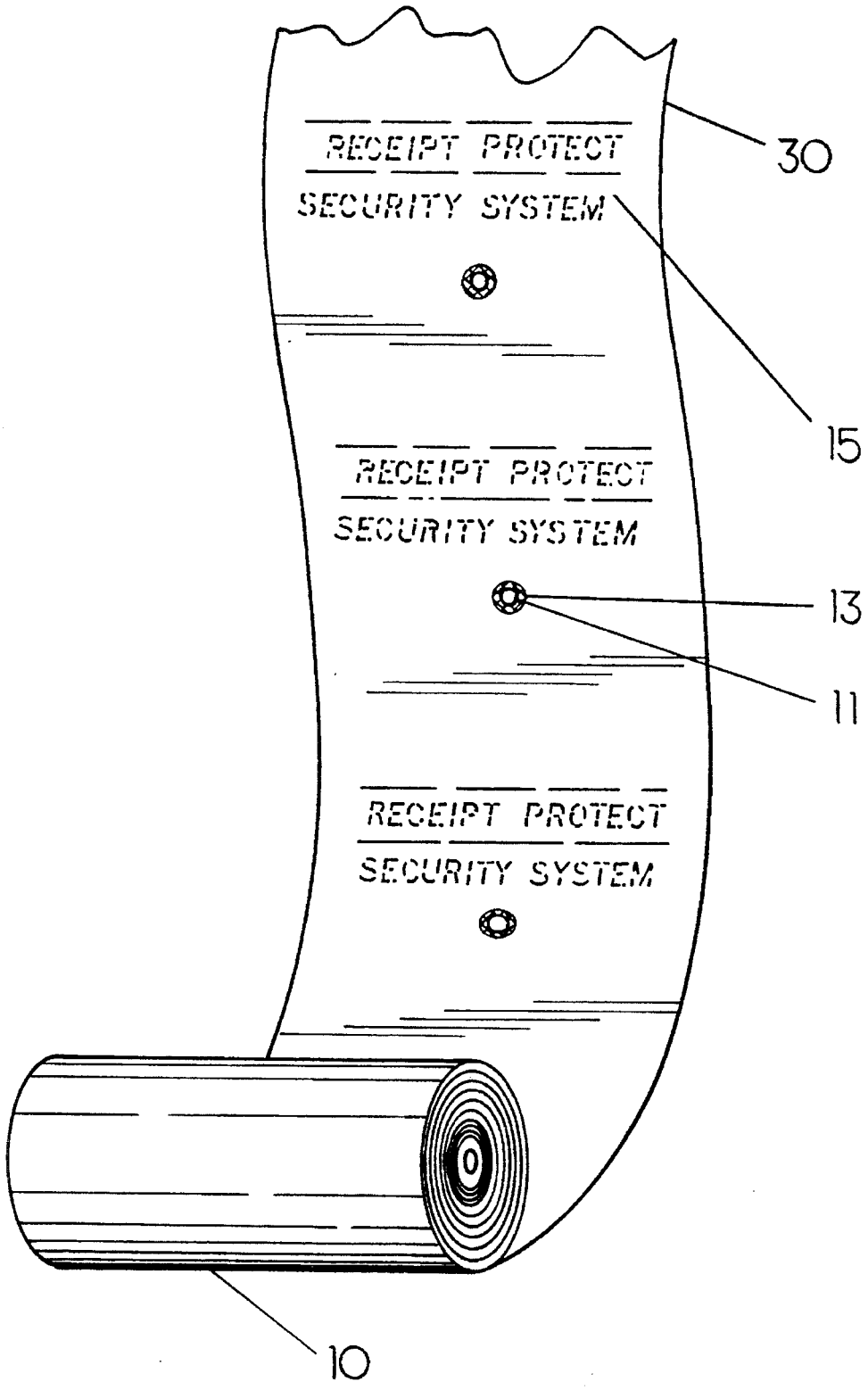
FIG. 2 is a perspective view of the reverse side of a register receipt tape as it would appear after the printing of a sales slip according to the present invention.

FIG. 2 depicts one side of a finished record 30 made according to the instant process. The record 30 shows fixed indicia 15 in broken lines, apertures 11, and markings 13 surrounding the periphery of the apertures 11. Preferably, fixed indicia 30 and markings 13 are invisible at normal visible wavelengths of light, yet readily visible when exposed to the special light source discussed above.

The preferred method for printing tamper-resistant records according to the present invention is as follows:

First, the fixed indicia is printed on one side of the paper at a manufacturing site removed from the location of the retailer. A first marking agent having a first pre-determined and identifiable photoluminescent characteristic is used to print the fixed indicia.

The paper having the fixed indicia printed on one side is then transferred a point of sale site, normally a seller of goods.

The paper is then installed in the printing apparatus described above. When a given item is sold, variable alphanumeric indicia are printed on the paper to record the sale of the item. The variable indicia may be printed on either side of the paper using a visible ink, dye, or pigment which includes a third marking agent having a having a third pre-determined and identifiable photoluminescent characteristic (which is preferably invisible under normal lighting conditions and different from the first and second marking agents).

Either before, after, or simultaneous to printing the variable indicia on the paper, or the fixed indicia, the paper is pierced with a piercing means. This can be done either at a manufacturing site, or at a point of sale.

It is to be understood that the invention is not limited in any manner to the embodiment described above, but includes any and all embodiments encompassed by the following claims.

We claim:

1. A method of printing tamper-resistant records comprising:

providing paper having a first side and a second side, and a marking agent having a predetermined and identifiable photoluminescent characteristic;

printing fixed indicia on the paper using the marking agent;

installing the paper in apparatus equipped with piercing means to pierce said paper;

piercing the paper with the piercing means to form a plurality of apertures therethrough;

installing the paper in apparatus equipped with print means to print variable alphanumeric indicia thereon; and supplying the marking agent having a predetermined and identifiable photoluminescent characteristic to the print means, and printing variable alphanumeric indicia on the paper.

2. The method of printing tamper-resistant records according to claim 1, further comprising:

printing the fixed indicia on the first side of the paper;

piercing the paper with the piercing means; and printing the variable alphanumeric indicia on the second side of the paper.

3. The method of printing tamper-resistant records according to claim 1, further comprising:

providing a marking agent having a predetermined and identifiable photoluminescent characteristic selected from the group consisting of ultraviolet fluorescence, visible fluorescence, infrared fluorescence, ultraviolet phosphorescence, visible phosphorescence, and infrared phosphorescence.

4. The method of printing tamper-resistant records according to claim 3, further comprising:

providing a marking agent selected from the group consisting of inks, dyes, and pigments.

5. The method of printing tamper-resistant records according to claim 1, further comprising;

prior to supplying the marking agent having a predetermined and identifiable photoluminescent characteristic to the print means, and prior to printing variable alphanumeric indicia on the paper:

transferring the paper to a point of sales site.

6. The method of printing tamper-resistant records according to claim 5, further comprising:

printing the fixed indicia on the first side of the paper;

piercing the paper with the piercing means; and printing the variable alphanumeric indicia on the second side of the paper.

7. The method of printing tamper-resistant records according to claim 5, further comprising:

providing a marking agent having a predetermined and identifiable photoluminescent characteristic selected from the group consisting of ultraviolet fluorescence, visible fluorescence, infrared fluorescence, ultraviolet phosphorescence, visible phosphorescence, and infrared phosphorescence.

8. The method of printing tamper-resistant records according to claim 7, further comprising:

providing a marking agent selected from the group consisting of inks, dyes, and pigments.

9. A method of printing tamper-resistant records comprising:

supplying paper having a first side and a second side, and a first marking agent having a first predetermined and identifiable photoluminescent characteristic;

printing fixed information on the first side of the paper using the first marking agent;

installing the paper in apparatus equipped with piercing means to pierce the paper;

piercing the paper with the piercing means to form a plurality of apertures therethrough;

installing the paper in apparatus equipped with print means to print variable alphanumeric indicia thereon; and supplying a third marking agent having a third predetermined and identifiable photoluminescent characteristic to the print means, and printing variable alphanumeric indicia on the second side of the paper.

10. The method of printing tamper-resistant records according to claim 9, further comprising:

supplying first and third marking agents having predetermined and identifiable first and third photoluminescent characteristics selected from the group consisting, of ultraviolet fluorescence, visible fluorescence, infrared, fluorescence, ultraviolet phosphorescence, visible phosphorescence and infrared phosphorescence.

11. The method of printing tamper-resistant records according to claim 10, further comprising:

supplying first and third marking agents selected from the group consisting of inks, dyes, and pigments.

12. The method of printing tamper-resistant records according to claim 9, further comprising:

prior to supplying the third marking agent having a third predetermined and identifiable photoluminescent characteristic to the print means, and prior to printing variable alphanumeric indicia on the paper:

transferring the paper to a point of sales site.

* * * * *